US006080051A

United States Patent [19]

Weber

[11] Patent Number: 6,080,051

[45] Date of Patent: Jun. 27, 2000

[54] APPARATUS FOR MACHINING CYLINDRICAL WORKPIECES

[75] Inventor: Wilfried Weber, Freudenstadt, Germany

[73] Assignee: Supfina Grieshaber GmbH & Co., Remscheid, Germany

[21] Appl. No.: 09/175,938

[22] Filed: Oct. 21, 1998

[30] Foreign Application Priority Data

Oct. 29, 1997 [DE] Germany ..... 297 19 168 U

[51] Int. Cl.[7] ..... B24B 21/16; B24B 21/00

[52] U.S. Cl. ..... 451/303; 451/304; 451/307; 451/49

[58] Field of Search ..... 451/49, 51, 168, 451/173, 303, 304, 307

[56] References Cited

U.S. PATENT DOCUMENTS 2,693,669 11/1954 Riedesel ..... 451/303
4,682,444 7/1987 Judge et al. ..... 451/303 X
5,775,978 7/1998 Brocksieper et al. ..... 451/303 X

*Primary Examiner*—Timothy V. Eley
*Attorney, Agent, or Firm*—Jones, Tullar & Cooper, P.C.

[57] ABSTRACT

A device for finishing cylindrical workpieces is described, having an arrangement for rotating the workpiece, two retaining arms, each having a support and a pressure cheek received in it, wherein at least one pressure cheek is floatingly seated on the associated support, and the pressure cheeks at least partially envelop the workpiece, a grinding belt, and belt guidance means guiding the grinding belt in such a way that it at least partially envelops the workpiece and is pressed against the workpiece by the pressure cheeks, as well as an arrangement which puts the retaining arms into a back-and-forth movement parallel with the axis of rotation (A) of the workpiece. Here, either the support or the pressure cheek have a lining of a plastic material, which slightly extends in a T-shape past the lateral walls of the quick-change adapter, and which can at least slightly be compressed elastically. The other component of the pair of support/pressure cheeks is embodied U-shaped in cross section and extends over the lining of the first mentioned component.

3 Claims, 2 Drawing Sheets

APPARATUS FOR MACHINING CYLINDRICAL WORKPIECES

FIELD OF THE INVENTION

The present invention relates to a device for finishing cylindrical workpieces, having an arrangement for rotating the workpiece, two retaining arms, each having a support and a pressure cheek received in it, wherein at least one pressure cheek is floatingly seated on the associated support, and the pressure cheeks at least partially envelop the workpiece, a grinding belt, belt guide means for guiding the grinding belt in such a way that it at least partially envelopes the workpiece and is pressed against the workpiece by the pressure cheeks, and an arrangement which puts the retaining arms into a back-and-fourth movement parallel with the axis of rotation of the workpiece.

BACKGROUND OF THE INVENTION

Such a device is known from EP 0 161 748 B1 (see the exemplary embodiment in accordance with claim 4 and the specification, column 5, line 53). There, the pressure cheek (referred to as an insert there) can be tilted in an axis parallel with respect to the axis of rotation of the workpiece as indicated by the arrow B in FIG. 5. To this end, a pin arranged in a support is passed through the pressure cheek.

The arrangement for turning the workpiece and the means for putting the retaining arms into a back-and-forth movement with respect to the axis of rotation of the workpiece, which are not shown in detail in the present application, are also represented in the mentioned document. It is furthermore pointed out that the retaining arms themselves can perform a pivot movement, which makes it possible for them to follow an eccentric rotating movement of the workpiece, for example, if the latter is constituted by the connecting rod bearing of a crankshaft or cam shaft.

A similar arrangement is described in U.S. Pat. No. 1,905,821, in DE 44 44 239 A1, in the prospectus of 3M company "Imperial Brand Microfinishing Film Roll" (1981) and in the article by Haasis, "Bandfinishing—Ein wirtschaftliches Feinbearbeitungs-verfahren" [Band Finishing—An Economical Fine Machining Process] in "Fachberichte für Oberflächentechnik" [Special Reports on Surface Technology], 8 (1970) vol. 9/10, pp. 203 to 208. Such band finishing machines additionally have arrangements for moving the grinding belt, as soon as it has been used up, forward over a defined section of length in such a way, that an unused grinding belt section becomes available for finishing the workpiece. Such arrangements are also known from the above mentioned patent documents.

The use of the supports (shoes) and pressure cheeks (inserts) in the prior art in accordance with EP 0 161 748 requires an adjustment of the inserts in relation to the cylindrical workpiece to be finished, or respectively to its surface to be finished (for example the connecting rod bearing surface of a crankshaft). Because of this, the process of changing the insert becomes complicated.

Furthermore, in spite of the desired shape correction by the use of incompressible grinding belts, it is often desired to retain a certain remaining elasticity of the pressure cheeks, so that the latter can be adapted to different initial diameters of the finished surface. This is desired not only for achieving an improvement of the surface and a shape correction, but also a reduction of the diameter to a defined final size. The pressure cheek is supposed to be slightly spread when being placed on a workpiece, whose diameter is greater than the nominal diameter, so that material is taken off until the nominal diameter has been achieved. This relates to the removal of material in the range of a few $\mu$m. Thus, within the limits mentioned, a certain amount of elasticity of the pressure cheeks should be assured, which makes possible and simplifies a simultaneous shape correction, surface improvement and working down to a final size (=nominal size).

SUMMARY OF THE INVENTION

It is an object of the present invention to provide a device in which the mounting and replacement of the pressure cheeks is at the same time particularly simple.

This object is attained by providing a lining to either the support or the pressure cheek lining is preferably made of plastic material. The lining slightly extends in a T-shape past the lateral walls of a quick-change adapter, and can be slightly compressed elastically. Wherein the other component of the pair of support/pressure cheeks is embodied U-shaped in cross section and extends over the lining. Furthermore, the present invention relates to different advantageous further developments.

An exemplary embodiment of the present invention and its advantageous further developments will be described in what follows by means of the drawing figures.

DESCRIPTION OF THE PREFERRED EMBODIMENTS

The exemplary embodiment has two retaining arms 1, 2, the lower portions of which can be moved toward and away from each other. Supports 3 (called quick-change adapters hereinafter) and 6 are arranged on respective ones of the retaining arms which support pressure cheeks 4 (called finishing shell hereinafter)and 7. These surround the surface to be finished of a workpiece 10, for example the connecting rod bearing of a crankshaft or cam shaft. The workpiece is rotated by devices (not represented). If this is a connecting rod bearing of a crankshaft, the axis of rotation A also performs a circular movement. In order to be able to follow this, the retaining arms 1, 2 are movably arranged on a device, not represented, which makes it possible for them to follow the movement of the shaft A.

Figure 3:
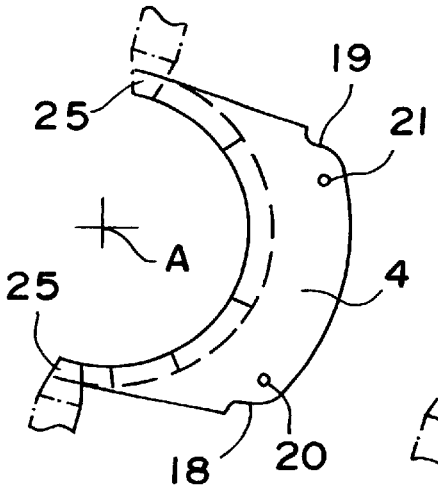
FIG. 3, is a finishing shell.
Figure 4:
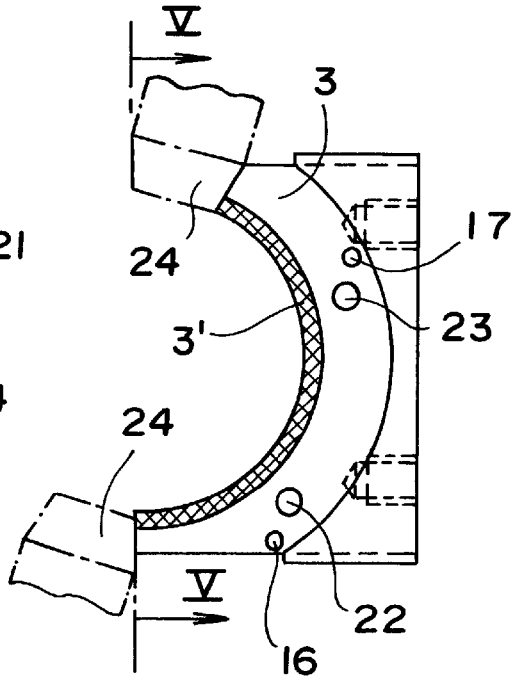
FIG. 4, is a quick-change adapter.
Figure 5:
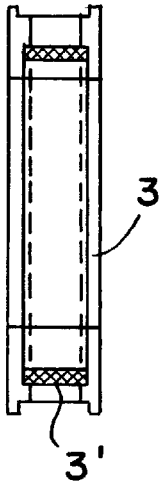
FIG. 5, is a plan view of the quick-change adapter in FIG. 4 in the direction of the arrows V—V.
Figure 2:
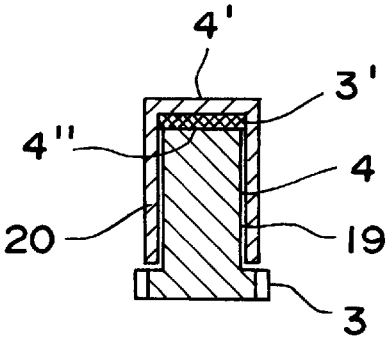
FIG. 2, is a section along the line II/II in FIG. 1.

A quick-change adapter 3, whose structural design can also be seen in FIGS. 2, 4, 5, is attached by means of screws to the retaining arm 1. As can be seen in FIG. 2 and FIG. 3, the quick-change adapter 3 is provided with a lining 3' on its inner contour. This lining consists, for example, of polyurethane or Vulkollan, i.e. a plastic material which can be at least slightly elastically compressed. As can be seen in FIG. 2—greatly exaggerated—the lining 3' laterally protrudes slightly past the lateral faces 19, 20 of the quick-change adapter 3, so that a T-shape results.

Figure 1:
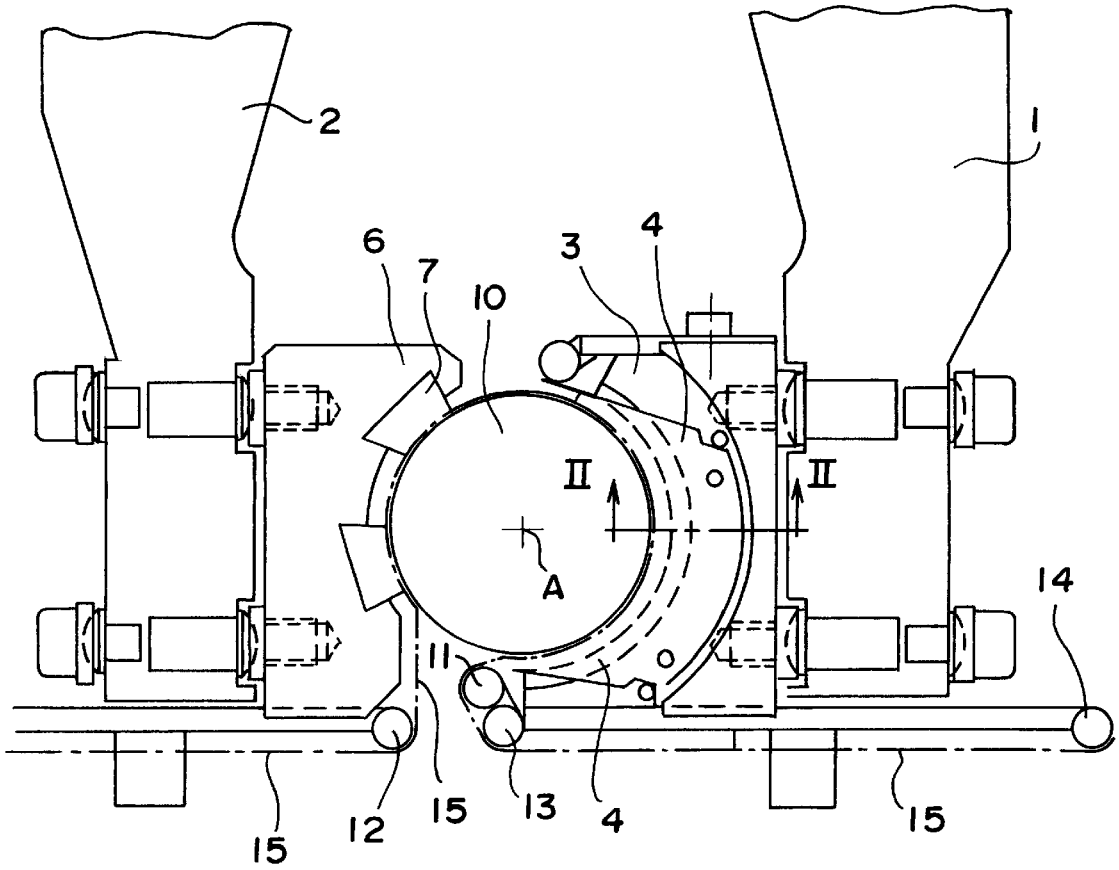
FIG. 1, is an exemplary embodiment.

This design of the quick-change adapter 3 makes it possible to push the finishing shell 4, which is U-shaped in cross section, on the quick-change adapter 3 in the way shown in FIG. 1 and FIG. 2. The finishing shell 4 is as noted above, referred to as a pressure cheek. In the course of pushing the finishing shell 4 on, the lining 3' is slightly compressed elastically from the direction of the narrow front faces so that, because of the compression and frictional forces being generated in the process between the lateral front faces of the lining 3' and the interior surface of the finishing shell, the latter is maintained sufficiently securely on the quick-change adapter 3. In this way the replacement of the finishing shells 3 is extremely simplified.

Because of this seating on the quick-change adapter 3, the position of the finishing shell 4 can be adapted to the position of the workpiece 10 and to different diameters. In the process, the lining 3' is respectively compressed or relieved.

The embodiment of the U-shape of the one element (the finishing shell 4) and the T-shape of the other element (quick-change adapter 3 with lining 3') can also be reversed with respect, so that the finishing shell 4 is made in a T-shape and the quick-change adapter 3 in a U-shape. They would still be pushed into each other in the same way.

The work surface 4' of the finishing shell 4 is the surface with which it presses on the belt 15 (see FIG. 1). In order to increase the frictional force between it and the belt 15, is can also be provided with a lining, for example of a ceramic material or Vulkollan.

The lower end of the retaining arm 2 holds the support 6, into which pressure cheeks 7 have been inserted in a dove-tailed manner, which also press on the belt 15. However, it is also possible to provide the system represented at the lower end of the retaining arm 1, or any other arbitrary system for pressing the belt 15, on the lower end of the retaining arm 2.

The grinding belt 15 is guided in the manner shown by means of belt guide bolts 11 to 14. The belt is one as described in the prospectus of 3M company mentioned at the outset and manufactured by it. Besides the mentioned movements, the retaining arms 1, 2 perform a back-and-forth movement perpendicularly with respect to the focal plane, and in the process take the grinding belt 15 along by means of the pressure cheeks 7 and the finishing shell 4. The workpiece 10 is simultaneously rotated. The combination of the back-and-forth movement of the grinding belt perpendicularly with respect to the focal plane, with the rotating movement of the workpiece 10 results in the desired microfinishing. The means for belt guidance are also known from the above mentioned prior art, so that their further description can be omitted.

Thus, the finishing shells 4 can be very easily replaced. It is only necessary (in FIG. 2) to pull them off when the retaining arms 1, 2 are opened and to insert a fresh shell. It finds the correct position without adjustment because of the described seating and its displaceability on the quick-change adapter 3. At the same time the desired adaptability to different radii of the workpiece 10 is also provided. The finishing shell 4 can be slightly widened in diameter and adapted to a larger diameter which, because of the elastic restoring force, is reduced until the workpiece 10 has reached the desired final size—in addition to the surface improvement and shape correction—. Even if the angle of wrap of the grinding belt is less than 360°, the finishing shell is practically automatically clipped on a round workpiece 10. This is the result of its elasticity. The latter, in turn, is also a function of the special U-shaped embodiment, wherein the lateral walls, which correspond to the legs of the U, provide a high resistance to expansion per se, i.e. counteract a permanent deformation, and make possible an expansion by simple means, while maintaining the circular shape within narrow limits. Pins 16, 17 are provided on the quick change adapter 3, which act together with detent, or respectively guide, surfaces 18, 19 of the finishing shell 4 (see FIG. 4) in order to achieve that the finishing shell 4 slides into the correct quick on the position change adapter 3 when being inserted. Furthermore, opening 20, 21 of the finishing shell 4, are aligned with corresponding openings 22, 23 in the quick-change adapter 3. The opening 22, 23 a slightly larger diameter than the openings 20, 21. Ball catchers can be inserted into the, which releasably engage the openings 21, 22 in order to improve the fixation in place of the finishing shells 4 on the quick-change adapter can be inserted into the opening 20, 23, without extensively reducing its functional movability.

Arrangements 24, or respectively 25, can also be seen in FIG. 3 and FIG. 4, which are used to fix the position of the quick-change adapter 3 at the end of the retaining arm 1, or respectively of the finishing shell 4 on the quick-change adapter 3.

What is claimed is:

1. A device for finishing cylindrical workpieces, which define an axis of rotation, comprising:

two retaining arms;

a support mounted to each retaining arm, each said support defining lateral walls;

at least one pressure cheek mounted to each support, with at least one pressure cheek being floatingly mounted on its respective support, said pressure cheeks together at least partially enveloping the workpiece;

a grinding belt;

grinding belt guide means for guiding said grinding belt in such a way that it at least partially envelops the workpiece, said grinding belt being pressed against the workpiece by said pressure cheeks; and a lining made of plastic material mounted to one of said supports, said lining extending slightly past said lateral walls of said support forming thereby a T-shape, said lining being adapted to be slightly compressed elastically, wherein at least one of said pressure cheeks defines a finishing shell associated with a respective support, said finishing shell being U-shaped in cross section and extending over said lining of its associated support, and wherein said retaining arms move back-and-forth in a direction parallel with the axis of rotation of the workpiece.

2. The device as defined in claim 1, wherein at least one of said supports is embodied as a quick-change adapter including guide pins, and said associated finishing shell has at least one guide surface which serves with an associated one of said guide pins for guiding said associated finishing shell onto said associated support.

3. The device as defined in claim 1, further comprising:

means for positioning said finishing shell, said means being provided in the circumferential direction of the workpiece.

* * * * *